United States Patent [19]

Vogt

[11] 4,420,186

[45] Dec. 13, 1983

[54] CONVERTIBLE LOW-BACK, HIGH-BACK UPHOLSTERED FURNITURE

[75] Inventor: Wilhelm Vogt, Bielefeld, Fed. Rep. of Germany

[73] Assignee: Hans Kaufeld GmbH & Co., Bielefeld, Fed. Rep. of Germany

[21] Appl. No.: 271,307

[22] Filed: Jun. 8, 1981

Related U.S. Application Data

[63] Continuation of Ser. No. 54,076, Jul. 2, 1979, abandoned.

[51] Int. Cl.[3] ..... A47C 3/00; A47C 17/00

[52] U.S. Cl. ..... 297/284; 5/59 R; 297/114; 297/230; 297/452

[58] Field of Search ..... 297/118, 284, 452, 457, 297/456, 399, 114, 391, 230, 231

[56] References Cited

U.S. PATENT DOCUMENTS

| | | | |
|---|---|---|---|
| 248,919 | 11/1881 | Crosgrave | 297/114 |
| 2,265,671 | 12/1941 | Quadri | 297/118 X |
| 2,377,958 | 6/1945 | Mann | 5/59 R |
| 2,394,969 | 2/1946 | Robinson | 5/59 R |
| 2,618,786 | 11/1952 | Robinson | 5/59 R |
| 2,651,058 | 9/1953 | Almoslino | 297/457 X |
| 3,110,911 | 11/1963 | Osborne et al. | 5/59 R |
| 3,360,806 | 1/1968 | Dunaway | 297/457 X |
| 4,148,521 | 4/1979 | Van Hook | 297/118 |

*Primary Examiner*—Francis K. Zugel

*Attorney, Agent, or Firm*—Pollock, Vande Sande & Priddy

[57] ABSTRACT

An article of upholstered furniture, such as an easy chair or sofa, has a padded back rest comprising a first portion which has a rigid insert embedded therein, and a second portion which has a flexible linkage embedded therein hingedly connected to the rigid insert in the first portion. The second portion is adapted to be manipulated relative to the first portion from a first position wherein said second portion overlies the back rest, to a second position wherein the second portion is folded upon itself and extends vertically above the back rest. A linkage embedded within the second portion is arranged to assume a variety of curvatures as the second portion is manipulated relative to the first portion of the back rest, and is constructed to exhibit a limit position which prevents the padded second portion from being displaced rearwardly relative to the first back rest portion when the second back rest portion is in its second position.

7 Claims, 6 Drawing Figures

CONVERTIBLE LOW-BACK, HIGH-BACK UPHOLSTERED FURNITURE

CROSS REFERENCE TO RELATED APPLICATION

This application is a continuation in part of U.S. application Ser. No. 54,076 filed July 2, 1979 now abandoned, for "Convertible Low-Back, High-Back Upholstered Furniture".

BACKGROUND OF THE INVENTION

The present invention relates to articles of upholstered furniture having overlaid padding, such as easy chairs of sofas provided with padded back rests. Known furniture articles of this general type have back rests of the so-called "low-back" type, wherein the back rest extends vertically to substantially the height of the shoulders of a person sitting on the furniture, or they are provided with back rests of the so-called "high-back" type which extend vertically to the height of the head of one seated on the furniture. One purchasing an article of furniture must select between these two kinds of upholstered furniture at the time of purchase. If he selects a "low-back" article of furniture, the effective height of the back rest can be increased by locating the furniture article against a wall, and by placing loose cushions operative to act as head rests on the top of the back rest. However this cannot be done if the low-back article of furniture is positioned in spaced relation to the walls of a room since, in such event, there would be nothing to maintain the loose cushions, placed on top of the back rest, in place and they would therefore simply fall off of the back rest when engaged by the head of one seated on the article of furniture.

In recognition of this present state of the art, it is the primary purpose of the present invention to provide an article of upholstered furniture, of the general type previously described, in which the padded portion of the furniture can be variably arranged even when the article is placed in a room in freely spaced relation to the walls thereof and, more particularly, to provide an easy chair or sofa which has a back rest of normal height that can be converted in simple fashion into a back rest of the high-back type.

SUMMARY OF THE INVENTION

In accordance with the present invention, a sofa or easy chair is provided with a back rest that includes two padding portions overlying a fixed back rest of low-back height, said two padding portions being interconnected to one another by means of inserts embedded within said two portions respectively. A first one of the portions is provided with a comparatively rigid insert disposed generally vertically and extending across the width of said first portion, and the upper edge of said rigid insert is hingedly connected to a flexible insert which is embedded within the second portion of the padding, said flexible insert being arranged to exhibit flexibility throughout at least a portion of its length from an initial position to permit said second portion to assume a plurality of different curvatures as the second portion is manipulated relative to the first portion, and to support the second portion in a desired orientation and to prevent its rearward displacement relative to the first portion when the second portion has been manipulated into a "high-back" configuration on the back rest.

In the first relative positions of said padding portions, the second padding portion overlies the forward surface of the fixed back rest and extends downwardly to a position wherein a free edge of the second padding portion is disposed closely adjacent to the seat of the article of furniture. In the second position, the second padding portion is folded upon itself and extends upwardly from and vertically above the first padded portion with the free edge of the second padded portion resting upon the upper surface of the fixed back rest. It has been found effective to provide the flexible insert within the second portion of the padding with a section which is horizontal in the "low-back" configuration of the furniture article, and to construct the flexible insert in such fashion that it can be bent in only a single direction to a limit position wherein the initially horizontal portion of the flexible insert is disposed vertically in substantially coplanar relation to the rigid insert of the first padding portion when the article of furniture is converted into its high-back configuration.

The rigid insert in the first portion of the back rest can take the form of a flat plate, and the flexible insert in the second portion of the back rest can consist of another flat plate which is hingedly connected to at least one articulated, multi-link hinge chain constructed with pinjointed links which overlap one another in the zone of unidirectional flexibility of the hinged chain. In this embodiment of the invention, it is advantageous if the flat plates extend throughout almost the entire width of the overlying padding, and to provide band-like flexible zones which extend in the longitudinal direction of the overlying padding at the opposing ends of the flat plates. Moreover, in this particular embodiment, it is preferably to provide a rigid plate which is secured as an extension to the free end link of the hinge chain.

In another embodiment of the invention, the flexible insert consists of a series of plates which are secured to one surface of the flexible band or the like, so that when the flexible band is manipulated into a flat configuration the edges of the attached plates come into engagement with one another to prevent flexing of the band beyond its said flat configuration.

The upholstered article of furniture constructed in accordance with the invention can be converted from a normal height, or low-back configuration, into a high-back article of furniture by simple manipulation of one portion of the back rest relative to the other. The convertibility of the furniture article is not detectable, however, in either of the two optional positions of the back rest portions, and the fact that the furniture article is convertible in the fashion described has no negative effect on the ornamental design which the furniture can assume. The aesthetic impression achieved by the article of furniture is attractive in both of its possible conversion positions, and it is not necessary to enter into design compromises simply to achieve the convertibility features which characterize the invention.

The mechanism which allows the furniture article to be converted between low-back and high-back configurations is arranged entirely within the overlying padding of the furniture, and is therefore not visible from the exterior of the article. The mechanism can, moreover, be built so sturdily that, even with frequent conversion between low-back and high-back configurations, a long and useful life for the article of furniture is assured. The upholstery of the overlying padding can, moreover, be made so taut that the overlying padding retains a selected position. This is an important consideration when the article of furniture has been converted into is high-back configuration since, in that configuration, it is necessary to assure that the head rest padding cannot fall in a rearward direction, and to further assure that the head rest padding will not fall forwardly either unless the second portion of the back rest is intentionally manipulated to convert the article of furniture back into its low-back configuration. The adjustment of the upholstery to achieve this result can be readily accomplished by one skilled in the art, and the degree of adjustment depends on various factors e.g., on the height of the overlying padding, and on the type and stiffness of the material employed therein.

BRIEF DESCRIPTION OF THE DRAWINGS

The foregoing objects, advantages, construction and operation of the present invention will become more readily apparent from the following description and accompanying drawings wherein.

DESCRIPTION OF THE PREFERRED EMBODIMENTS

Figure 1:
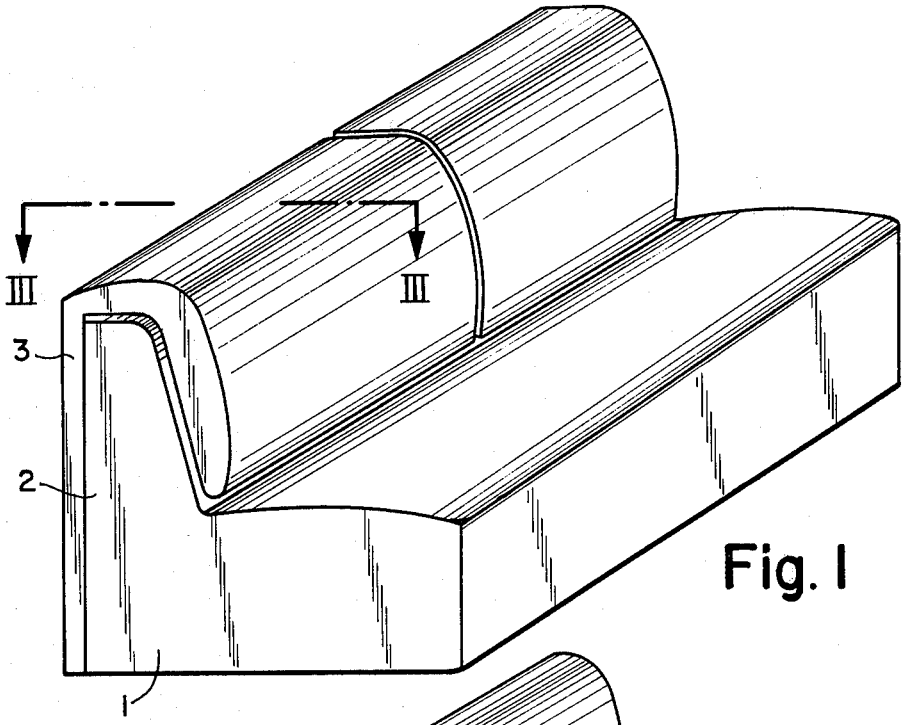
FIG. 1 is a perspective view of a two-seat sofa constructed in accordance with the present invention, and showing the padding overlying the back rest in the low back position of the furniture article.

Referring initially to FIGS. 1 through 5 inclusive, which relate to a first embodiment of the invention, and wherein like numerals refer to like parts throughout, the illustrated armless two-seat sofa consists of a seat 1 and an adjoining back rest 2. The seat 1 comprises a seat frame 1*b*, fabricated for example of wood, and a seat cushion 1*a*. The back rest 2 consists of a back rest frame 2*b* provided with back rest padding 2*a*.

Further padding comprising a cushion 3 overlies the back rest 2. Said cushion 3 includes a portion 3*a* which extends generally vertically across the back of the back rest and which has a rigid insert 3*b*, e.g., a generally vertically extending board, embedded therein adjacent to the vertical portion of the back rest frame 2*b*. An additional board 3*c* is embedded within a second portion of the padding 3 and extends in a generally horizontal direction, forwardly of the vertical board 3*b*, when the overlying padding 3 is in the low-back configuration of the back rest. The two boards 3*b* and 3*c* each extend throughout the entire width of an individual seat of the article of furniture, and the board 3*c* is connected to board 3*b* by means of a hinge 4 (see FIG. 4) which permits the two boards to be manipulated between the relative 90° angular position shown in FIG. 3, and the further relative position shown in FIG. 4 wherein both boards 3*b* and 3*c* are substantially coplanar with one another.

The two boards 3*b* and 3*c* are embedded within the padding material 3*a*, along with the mechanism (to be described) which adjoins board 3*c*, and these elements of the present invention are completely concealed by the padding material. The rear or first portion of the overlying padding 3 extends in generally fixed position across the entire width of the rear surface of the back rest 2, and the second or forward portion of the padding 3 includes (as depicted in FIGS. 1 and 3) a section which extends in generally horizontal orientation across the top of back rest 2 and which then extends downwardly across the front surface of back rest 2 to a position wherein the lower end or free edge of the said second portion of padding 3 reaches seat cushion 1*a* when the furniture article is in its low-back configuration.

Figure 2:
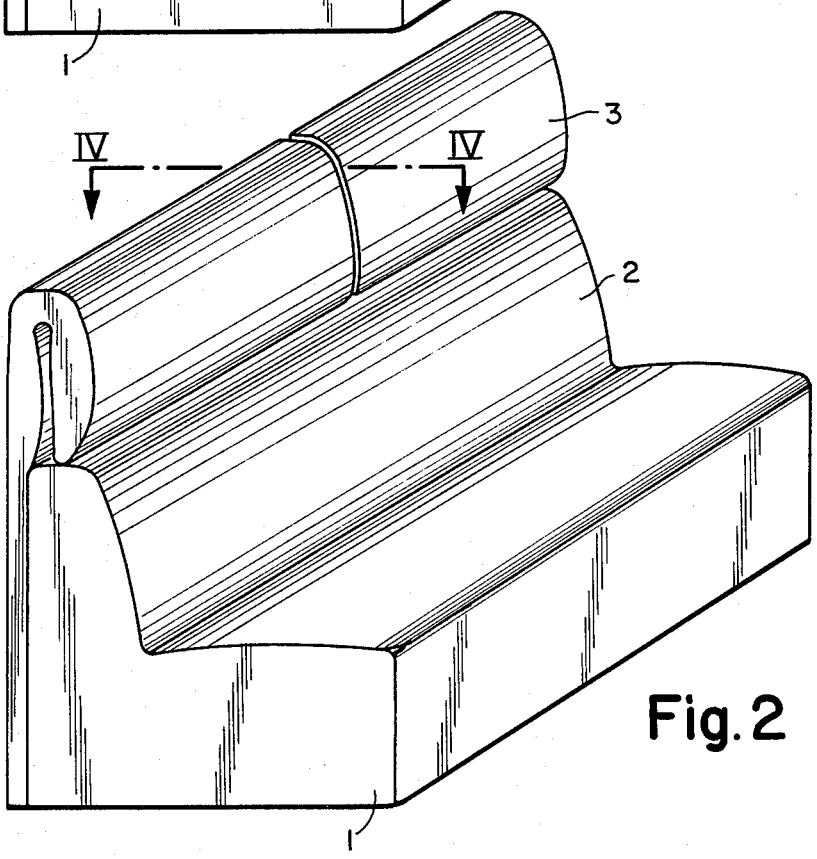
FIG. 2 is a perspective view of the sofa shown in FIG. 1 with the padding raised to form a head rest in the high-back position of the furniture article.

The hinge 4 is a toggle hinge of the type shown in Borsani U.S. Pat. No. 3,363,281 issued Jan. 16, 1968, except that it does not employ a spring of the type contemplated in the Borsani patent; such toggle hinges without springs are commercially available from the German firm Hafele, 7270 Nagold, West Germany. As described in the Borsani patent, the hinge includes a pair of hinge plates which are interconnected to one another by pivotally mounted links which cooperate with the hinge plates so that the hinge can be manipulated between a position wherein the plates are at substantially right angles to one another (as shown in FIG. 1 of the aforementioned Borsani patent, and as would be the case in FIG. 3 of the instant invention) and a further position wherein the hinge plates are substantially in alignment with one another (as shown in FIG. 2 of the Borsani patent, and as would be the case in FIG. 4 of the instant invention). Accordingly, when the Borsani toggle hinge is used to interconnect boards 3*b* and 3*c*, and the structure of the present invention is manipulated into the position shown in FIG. 4, the hinge 4 prevents board 3*c* from being displaced beyond the vertical position shown in FIG. 4 relative to board 3*b*.

Figure 3:
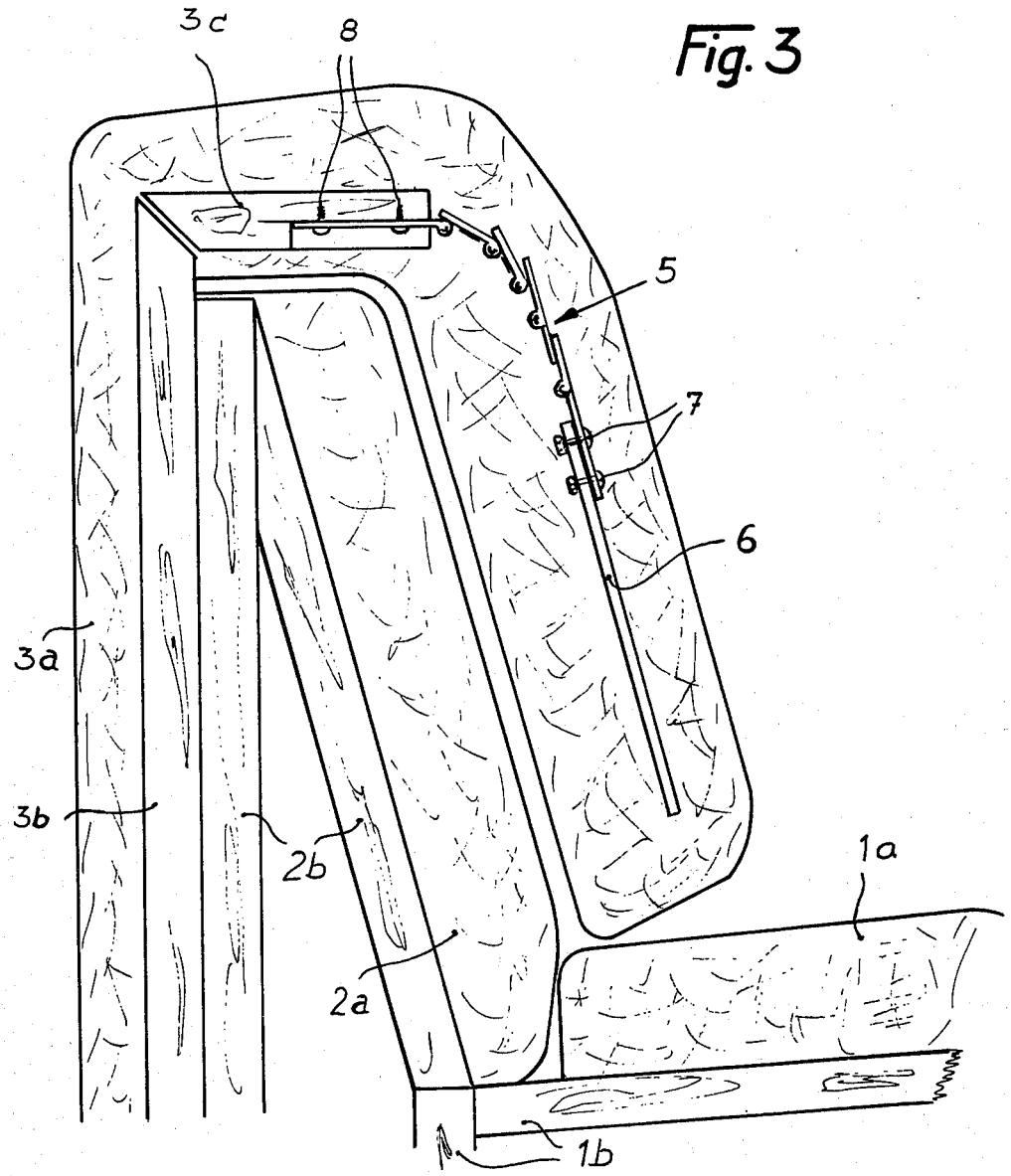
FIG. 3 is a section taken through the the plane designated III—III in FIG. 1.
Figure 4:
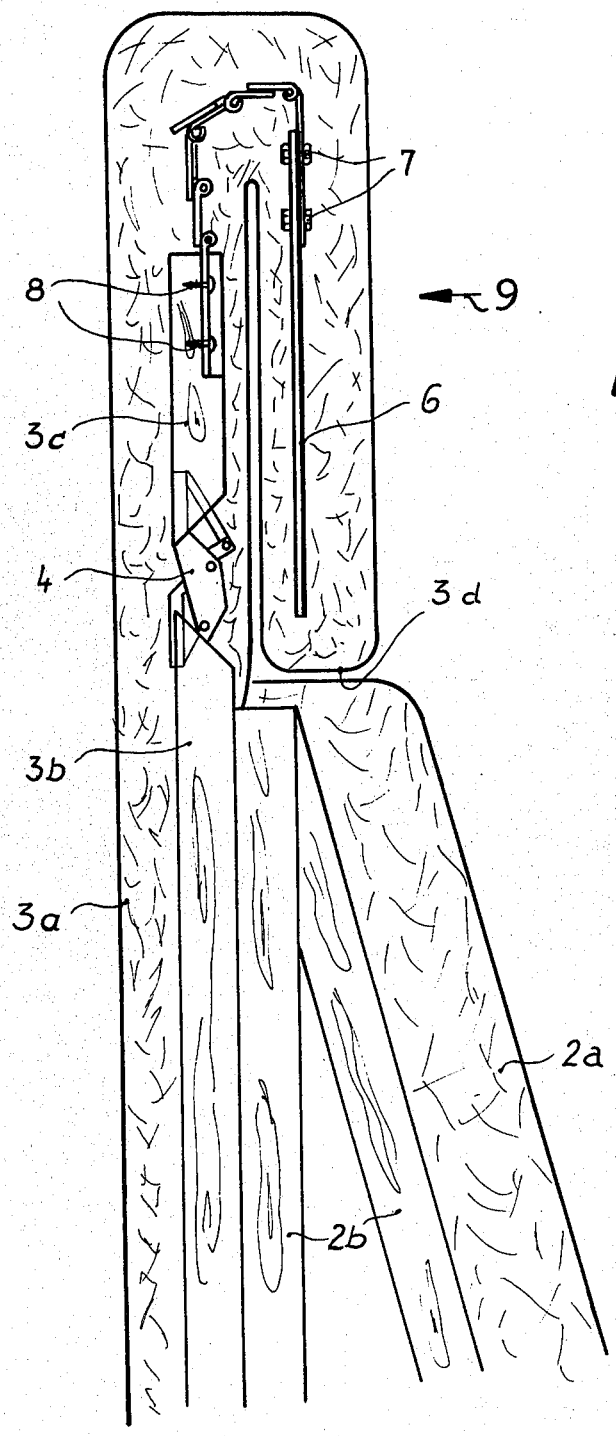
FIG. 4 is a section taken through the plane designated IV—IV of FIG. 2.

The structure and operation of hinge 4, as will be apparent from the aforementioned Borsani patent, is moreover such that when the hinge is manipulated from the position which it would assume in FIG. 3 of the present case to the position shown in FIG. 4, the hinge plates shift laterally relative to one another; and, as a result, when the structure of the present invention is manipulated into the position shown in FIG. 4, the adjacent ends of boards 3*b* and 3*c* are more widely spaced from one another than in the position shown in FIG. 3, i.e., board 3*c* shifts in position away from board 3*b*. This operation can occur in the present invention inasmuch as the interior padding material which surrounds board 3*c* is resilient and compressible, e.g., it can comprise materials such as feathers or plastic foam, and therefore, even though the upholstered furniture of the present invention may be covered by a material which is not significantly stretchable, e.g., a textile or leather material, the board 3*c* may shift longitudinally away from board 3*b* as the furniture is manipulated into the position shown in FIG. 4, and may shift back toward board 3*b* as the furniture is manipulated from the FIG. 4 position back toward the FIG. 3 position, as a result of the compression of the padding material within the upholstered furniture, and without disrupting or stretching the cover material.

Figure 5:
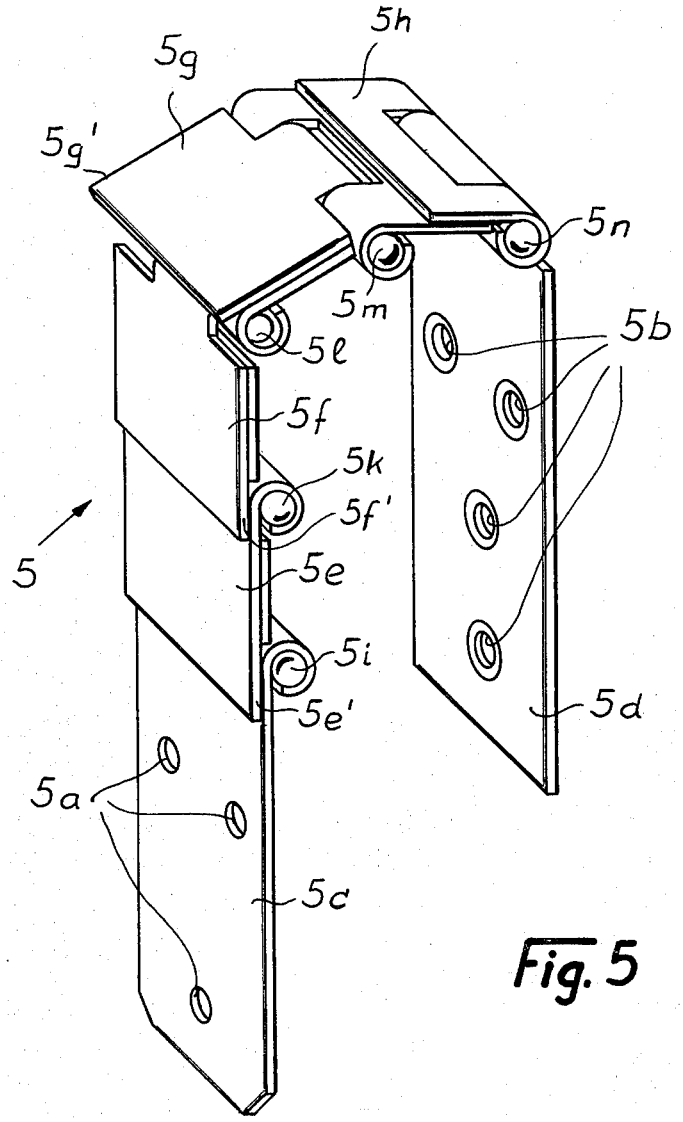
FIG. 5 depicts a chain of overlapping hinge links forming a flexible linkage constructed in accordance with one embodiment of the present invention.

A hinge chain 5, provided with overlapping links of the type shown in FIG. 5, is attached to inner board 3*c* at both ends of the second portion of the overlying cushion or padding 3. Each multi-link hinge chain 5 consists of a plurality of individual hinge plates having their ends bent into tubular configurations to form links through which link pins 5*i*, 5*k*, 5*l*, 5*m*, and 5*n* are inserted. The hinge chain further includes a first end member 5*c* which takes the form of a plate which is attached, by means of screws 8, to the end of board 3*c* remote from hinge 4. Connected to this first end member 5*c*, in sequence, are the intermediate hinge members 5*e*, 5*f*, 5*g*, and 5*h*, and a second end member 5*d*. The intermediate members 5*e*, 5*f*, and 5*g* are provided with flanges 5*e*', 5*f*', and 5*g*' which overlap the link pins 5*i*, 5*k* and 5*l*. These overlapping flanges make it impossible for the intermediate members 5*e*, 5*f* and 5*g* to be displaced rearwardly relative to one another beyond the vertical raised position of the padding and embedded link members shown in FIG. 4.

The first end member 5*c* has holes 5*a* therein through which the screws 8 can extend to attach first end member 5*c* to board 3*c*. The other end member 5*d* also has holes 5*b* therein through which screws 7 (see FIG. 4) can extend to secure a further internal board 6 to said second end member 5*d*. This further board 6 has about the same width as the multi-link hinge chain 5 and extends across the padding on its interior at a position closely adjacent to the bottom or free end 3*d* of the overlying cushion 3.

FIG. 3 illustrates the arrangement of the internal mechanism of the overlying padding when the padding is placed in the configuration shown in FIG. 1, i.e., in the low-back configuration of the article of furniture. FIG. 4 shows the arrangement which the internal mechanism assumes when the overlying padding and its internal mechanism are displaced into the position shown in FIG. 2, i.e., into the high-back configuration of the article of furniture. In the configuration shown in FIG. 4, it is apparent that the rear zone of the inserts, consisting of inner board 3*b*, hinge 4, internal board 3*c*, first end member 5*c* of the hinge chain, and the two adjoining intermediate links 5*e* and 5*f* of said hinge chain, cannot yield in a rearward direction when pressure is applied in the direction of arrow 9 from the front toward the rear of the article of furniture. On the other hand, since the intermediate member 5*h* of the hinge chain is constructed without an overlapping flange, it is possible to fold back the adjoining front zone of the overlying cushion 3. This facilitates cleaning of the inside of the overlying cushion 3 when such cleaning is necessary or desirable.

The hinge chain shown in FIG. 5 has unidirectional flexibility, and is adapted to be displaced in one direction only from an initial position exhibiting a desired or predetermined curvature to a variety of other selected curvatures. Various mechanisms operating in this fashion can be provided. One alternative mechanism, adapted to replace the multi-link hinge chain 5 or, with suitable articulation, adapted to replace both the hinge chain 5 and internal board 3*c*, is shown in FIG. 6.

Figure 6:
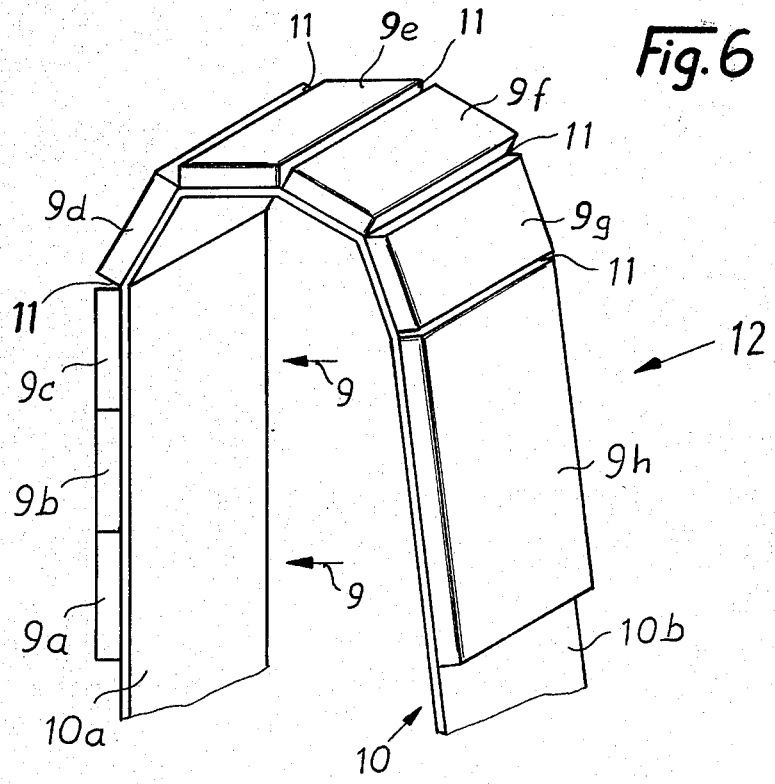
FIG. 6 depicts another embodiment of the present invention comprising a flexible band which can be bent only in a single direction.

The alternative unidirectionally flexible insert shown in FIG. 6 has been designated 12 and consists substantially of a flexible band 10 having an under surface 10*a* and an upper surface 10*b*. In the illustrated embodiment, eight plates 9*a*–9*h* are secured in closely adjacent relation to one another on the upper side or upper surface 10*b* of band 10, and are so positioned relative to one another that the edges of the adjacent plates come into engagement with one another when the flexible band 10 is displaced into a flat configuration. The various plates can be secured to the flexible band 10 by means of appropriate fasteners, or by an adhesive. The arrangement of the plates 9*a*–9*h* achieves the desired unidirectional flexibility of the overall structure, e.g., in the particular configuration shown in FIG. 6 the plates 9*a*–9*c* abut one another to provide, in cooperation with the adjoining portion of band 10, a flat generally vertically extending structure which can yield rearwardly as a unit in response to pressure applied in the direction of arrows 9, but said plates 9*a*–9*c* cannot be displaced relative to one another i.e., the unit cannot curve in a direction beyond its depicted flat condition, in response to such pressure. On the other hand, those portions of the band which have not been bent into the flat condition shown adjacent to plates 9*a*–9*c* can be bent into any desired curvature to achieve the overall U-shape configuration of the band shown in FIG. 6 to achieve a high-back configuration corresponding to that shown in FIGS. 2 and 4. When bent in this fashion, V-shaped recesses 11 are formed between the individual plates.

The plates can be made of various lengths in the embodiment of FIG. 6. For example, plate 9*h* is substantially longer than any of the individual plates 9*a*–9*g* and accordingly corresponds to inner board 6 shown in FIGS. 3 and 4.

It should be noted, moreover, that the unidirectionally flexible elements shown in FIGS. 5 and 6 include hinge portions which can perform the function of the hinge means 4 described in reference to FIG. 4, thereby eliminating need for use of such a hinge. For example, the plate 5*c* shown in FIG. 5 could be attached directly to board 3*b* (FIG. 4), thereby permitting elimination of hinge 4 and board 3*c* shown in FIG. 4. This would simply require that the unidirectionally flexible element be provided with additional hinges to assure that it is of proper length. Similarly, plate 9*a* and flexible band 10 of FIG. 6 could be attached directly to board 3*b* of FIGS. 3 and 4, thereby again eliminating need for the hinge 4.

The inserted unidirectionally flexible linkage employed in the various embodiments of the present invention insures that, when the forward portion of the overlying padding 3 is raised and folded upon itself, it cannot yield rearwardly under pressure applied to the folded padding in the direction of the arrow 9 shown in FIGS. 4 and 6. When the overlying padding is displaced into the high back configuration, the bottom or free end 3*d* of the overlying cushion 3 rests on the top of the rigid back rest upholstery 2*a* (see FIG. 4) to provide a head rest which is aesthetically coordinated with the remainder of the article of furniture.

Having thus described my invention I claim:

1. An article of upholstered furniture adapted to be sat upon and comprising a substantially horizontal padded seat and a substantially vertical padded back rest attached thereto, a padded cushion attached to said padded back rest, said cushion comprising a first portion which overlies the rear surface of said back rest and has a generally vertically extending insert embedded therein, said padded cushion further comprising a second cushion portion having an elongated, unidirectionally flexible element embedded therein, hinge means connecting one end of said unidirectionally flexible element to one end of said insert at a position adjacent the uppermost edge of said back rest, said second cushion portion, said unidirectionally flexible element, and said hinge means being adapted to be manipulated into a first position wherein said second cushion portion overlies the forward padded surface of said back rest with a free edge of said second cushion portion being disposed closely adjacent to said padded seat whereby said article of furniture is adapted to be sat upon in a low-back furniture configuration, and being adapted to be manipulated into a second position wherein said second cushion portion is folded upon itself and extends upwardly from and vertically above said padded back rest with the said free edge of said second cushion portion resting upon the uppermost edge of said padded back rest to provide a padded head rest which is disposed immediately above said padded back rest whereby said article of furniture is adapted to be sat upon in a high-back furniture configuration, said embedded unidirectionally flexible element being constructed to exhibit flexibility in a single direction only relative to a predetermined limiting orientation which is defined by the said second position of said second cushion portion, whereby said unidirectionally flexible element is adapted to assume a plurality of different curvatures within said padded cushion as said second cushion portion is manipulated from said first position into said second position, or vice versa, relative to said padded back rest but said limiting orientation of said embedded unidirectionally flexible element inhibits rearward displacement of said second cushion portion relative to said padded back rest when said second cushion portion is in its said second position.

2. The structure of claim 1 wherein said embedded unidirectionally flexible element includes a portion which is disposed substantially horizontally across the top of said back rest when said article of furniture is in its low-back configuration and which is adapted to be displaced about said hinge menas into substantially coplanar relation to said insert when said article of furniture is in its high-back configuration.

3. The structure of claim 1 wherein said embedded unidirectionally flexible element comprises a multi-link hinge chain having a plurality of hinge plates which are interconnected to one another by link pins, at least some of said hinge plates having flanges which extend longitudinally beyond said link pins and which are adapted to engage the surface of an adjacent hinge plate to limit the extent to which said element can be flexed in a given direction.

4. The structure of claim 3 wherein a pair of flat plates are attached respectively to the opposing ends of said multi-link hinge chain.

5. The structure of claim 1 wherein said generally vertically extending insert comprises a first flat plate which extends within the said first portion of said cushion across substantially the entire width of said first portion, said embedded unidirectionally flexible element comprising a second flat plate which is attached by said hinge means to said first flat plate and which extends within said second cushion portion throughout substantially the entire width of said second cushion portion.

6. The structure of claim 5 wherein said embedded unidirectionally flexible element comprises a pair of multi-link hinge chains, means for attaching first ends of said hinge chains respectively to opposing ends of said second flat plate, and a further flat plate attached to and extending between the other ends of said hinge chains.

7. The structure of claim 1 wherein said embedded unidirectionally flexible element comprises at least one elongated flexible band having a plurality of plates attached to one surface thereof, the adjacent edges of said plates being adapted to engage one another when said flexible band is in a flattened condition to inhibit the flexing of said band beyond its said flat condition.

* * * * *